US007607539B2

(12) United States Patent
Freeze

(10) Patent No.: US 7,607,539 B2
(45) Date of Patent: Oct. 27, 2009

(54) CHILD RESISTANT BLISTER PACKAGE

(75) Inventor: Timothy Freeze, Mebane, NC (US)

(73) Assignee: MeadWestvaco Corporation, Glen Allen, VA (US)

( * ) Notice: Subject to any disclaimer, the term of this patent is extended or adjusted under 35 U.S.C. 154(b) by 455 days.

(21) Appl. No.: 10/560,201

(22) PCT Filed: Jun. 10, 2004

(86) PCT No.: PCT/US2004/018513

§ 371 (c)(1),
(2), (4) Date: Dec. 8, 2005

(87) PCT Pub. No.: WO2004/110896

PCT Pub. Date: Dec. 23, 2004

(65) Prior Publication Data

US 2006/0138015 A1 Jun. 29, 2006

Related U.S. Application Data

(60) Provisional application No. 60/477,584, filed on Jun. 10, 2003.

(51) Int. Cl.
*B65D 83/04* (2006.01)

(52) U.S. Cl. ..... 206/531; 53/462; 206/532

(58) Field of Classification Search ..... 206/528, 206/530, 531, 532, 534, 538, 539; 53/449, 53/461, 462, 467
See application file for complete search history.

(56) References Cited

U.S. PATENT DOCUMENTS

| | | | | |
|---|---|---|---|---|
| 4,125,190 | A | 11/1978 | Davie, Jr. et al. | |
| 4,870,764 | A * | 10/1989 | Boone | 206/530 |
| 5,242,055 | A | 9/1993 | Pora | |
| 5,758,774 | A * | 6/1998 | Leblong | 206/531 |
| 5,927,500 | A | 7/1999 | Godfrey et al. | |
| 6,659,280 | B2 * | 12/2003 | Paliotta et al. | 206/531 |
| 6,951,282 | B2 * | 10/2005 | Jones | 206/531 |
| 2002/0162768 | A1 | 11/2002 | Bolnick et al. | |
| 2002/0166792 | A1 | 11/2002 | Filion et al. | |
| 2003/0213721 | A1 | 11/2003 | Jones | |
| 2004/0182738 | A1 * | 9/2004 | Williams-Hartman | 206/531 |
| 2006/0249420 | A1 | 11/2006 | Hession | |
| 2006/0289328 | A1 | 12/2006 | Hession | |

FOREIGN PATENT DOCUMENTS

EP 0 162 378 A2 11/1985

* cited by examiner

*Primary Examiner*—Luan K Bui
(74) *Attorney, Agent, or Firm*—Alison R. Scheidler; Tsugihiko Suzuki

(57) ABSTRACT

The invention provides a substantially child resistant package. A gate panel (110) and a tab panel (140) are secured to an aperture panel (120). At least one aperture (123) is formed on the aperture panel. At least one gate (114) is formed on the gate panel and is aligned with the aperture when the gate panel is in contact with the aperture panel. At least one partially detachable tab (146) is formed on the tab panel and is aligned with the gate when the tab panel is in contact with the gate panel. In an exemplary package, a blister package (11) is aligned with and secured to the aperture panel. The gate panel is secured to the aperture panel and blister package. The tab panel is secured to the gate panel.

33 Claims, 7 Drawing Sheets

CHILD RESISTANT BLISTER PACKAGE

CROSS-REFERNCE TO RELATED APPLICATIONS

This application claims priority to U.S. Provisional Application No. 60/477,584, filed Jun. 10, 2003, the entirety of which is incorporated herein by reference.

BACKGROUND OF THE INVENTION

This invention relates to a child resistant blister package.

The use of a blister package for items such as pharmaceutical pills is well known. As illustrated in FIGS. 1 and 2, a conventional blister package 10 includes a blister base 11, perimeter 15, blister cells 20, a product 30 and a backing layer 40. The base 11 and cells 20 are typically formed from a substrate such as a thermo-formed plastic or other suitable material. Typically after a product 30, such as a pill or other suitable product, is placed in the blister cells 20, a backing layer 40 such as foil, paperboard or other suitable material is secured to the base 11 to cover the open area of the blister cells 20. A product 30 is typically removed from a blister cell 20 by applying pressure or other suitable manipulation of the blister cell 20 to create an opening (not shown), such as a tear or rupture in the backing layer 40.

Typically when the backing layer 40 is strong or rigid, gates (not shown) or other suitable weakened areas are formed in the backing layer 40 in the general vicinity of each blister cells 20. The gates (not shown) assist with removing the product 30 through the backing layer 40. The gate (not shown) makes the backing layer 40 easier to tear or puncture for removing the product 30.

While conventional blister packages 10 are suitable for many applications there are several deficiencies in their design. While they provide easy removal of the product 30 as described above, they offer little resistance to children opening the package 10 30. Child resistance is a feature that is particularly desired for unit dose pharmaceutical packaging. Various regulations or guidelines are prescribed for making packages child resistant. In general, a child resistant package must be designed and operationally tested to ensure that the package offers sufficient resistance to children accessing the product. While child resistance is an important feature, however, it is also desirable that a package be designed so that adults can open a package with minimal instructions. Furthermore it is desirable that a package can be opened by adults lacking manual dexterity or strength. Based on at least the above deficiencies in the prior art, what is needed is a child resistant package.

SUMMARY OF THE INVENTION

The invention provides a substantially child resistant blister package. A blister package is aligned with and secured to an aperture panel. The blister cells extend through apertures on the aperture panel. A gate panel is aligned with and secured to the blister package. The gate panel has gates formed in the general vicinity of each blister cell. A tab panel is secured to the gate panel. The tab panel has tabs formed in the general vicinity of each gate. The tab regions of the tab panel are not tightly secured to the gate panel.

BRIEF DESCRIPTION OF THE FIGURES

Other features of the invention will become more apparent in the description below contain herein and can be further understood by reading the accompanying figures, wherein like characters represent like parts throughout the several views.

DESCRIPTION OF THE INVENTION

Figure 1:
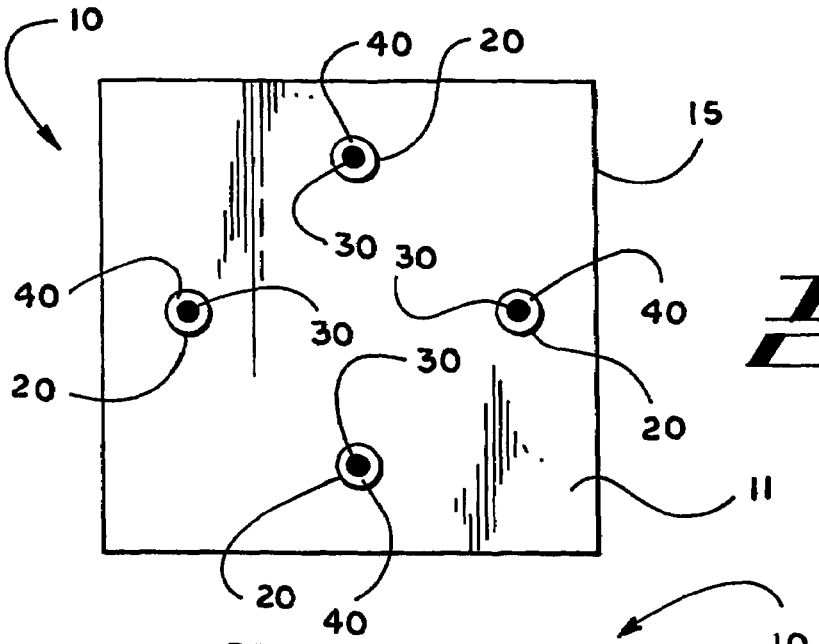
Fig. 1 PRIOR ART
FIG. 1 is a top plan view of a conventional blister package.
Figure 2:
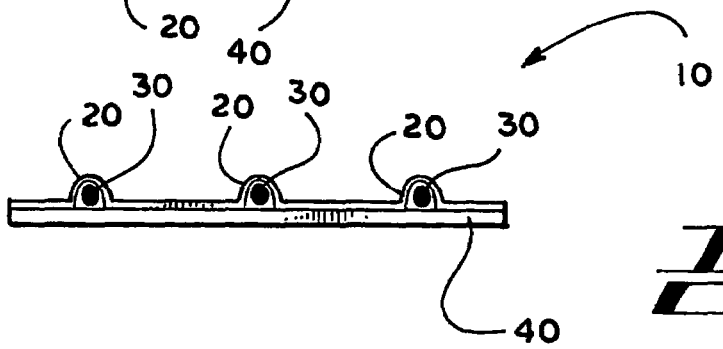
Fig. 2 PRIOR ART
FIG. 2 is an elevation view of FIG. 1.
Figure 3:
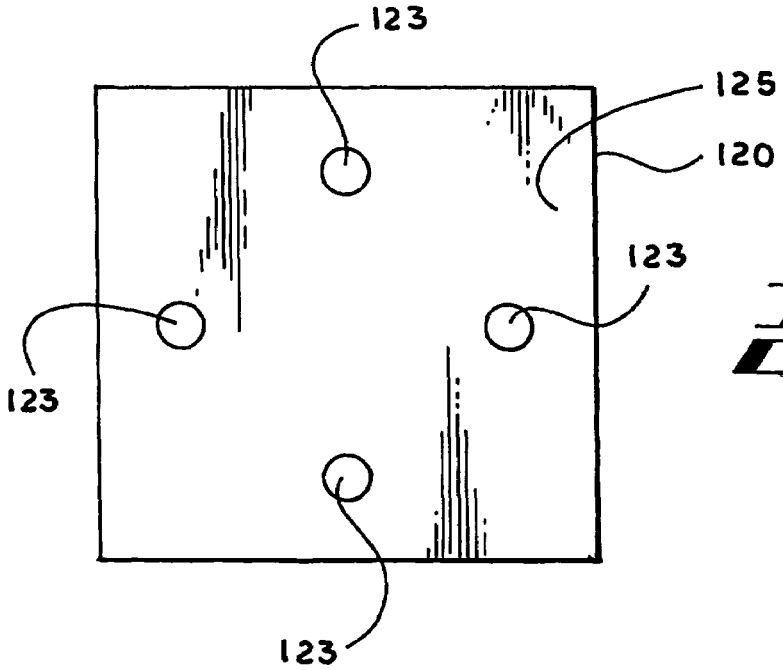
FIG. 3 is a plan view of an aperture panel according to the invention

FIG. 3 illustrates an exemplary aperture panel 120 with exemplary apertures 123 and perimeter 125. The apertures 123 are designed and laid out to support a blister package such as the conventional blister package illustrated in FIGS. 1-2. It is to be understood that a wide variety of configurations and shapes for both the apertures 123 and aperture panel 120 are within the scope of the invention.

Figure 4:
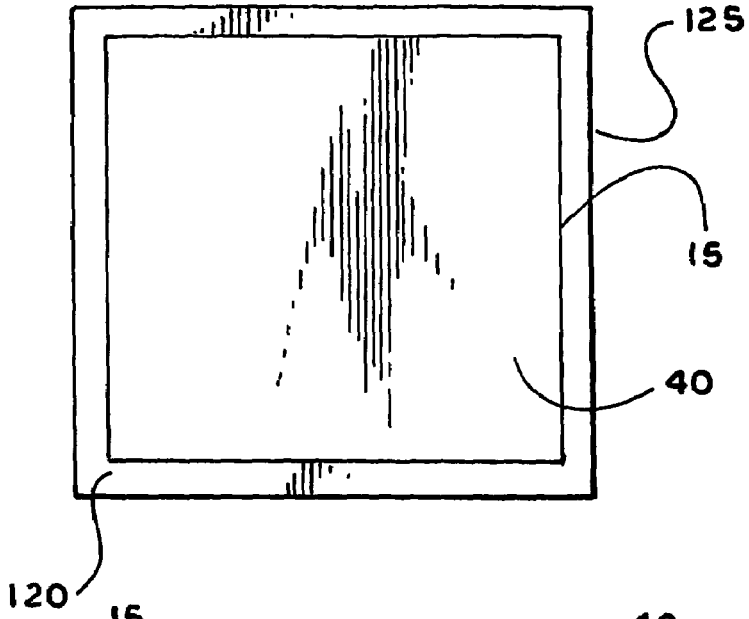
FIG. 4 is a plan view of a blister package secured to the aperture panel according to the invention.
Figure 5:
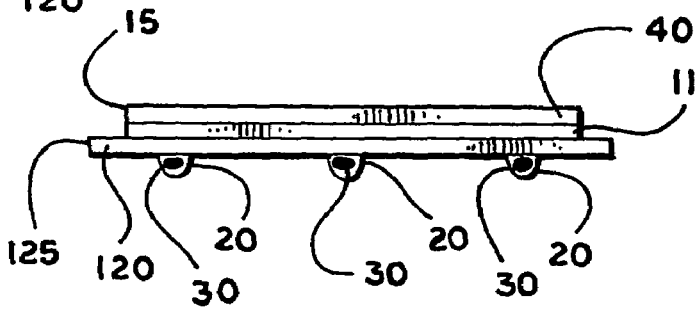
FIG. 5 is an elevation view of FIG. 4.

FIGS. 4 and 5 illustrate a blister base 11 supported by the aperture panel 120. The base 11 can also be secured to the aperture panel 120 using any suitable technique including adhesives. For example, the aperture panel 120 could be coated with an adhesive coating and heat and/or press applied to the blister base 11. As illustrated the blister cells 20 extend at least partially through the apertures 123 in the aperture panel 120. Backing layer 40 with perimeter 15 covers blister base 11 on the side opposite the aperture panel 120.

Figure 6:
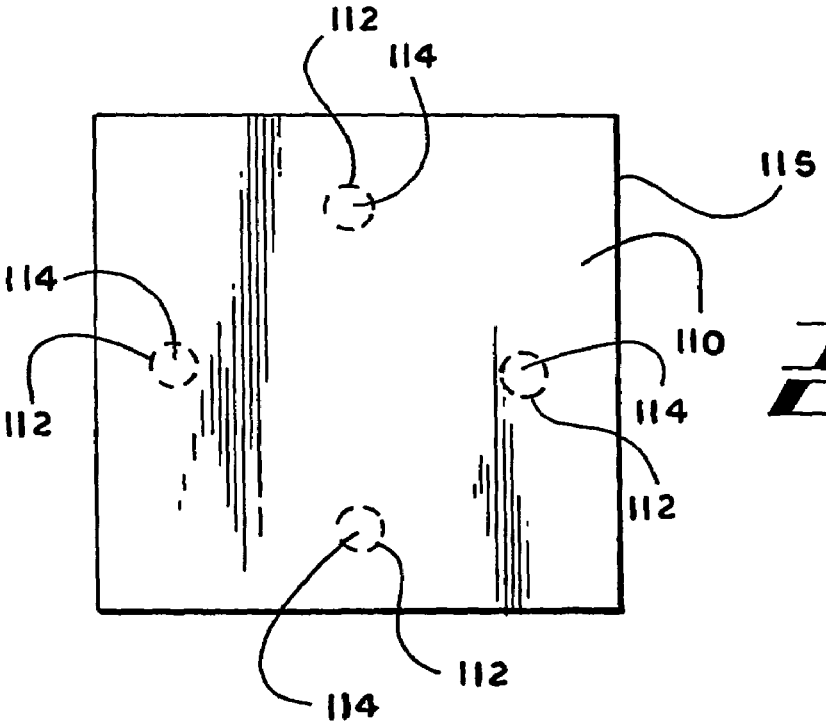
FIG. 6 is a plan view of a gate panel according to the invention.

FIG. 6 illustrates an exemplary gate panel 110 with exemplary gates 114 and perimeter 115. In an exemplary method the gates 114 can be formed by partial die cut or other suitable means. The gate boundary 112 is designed to substantially align with the blister cells. The perimeter 115 of the gate panel 110 is illustrated as a straight line; however it is to be understood that the shape of the perimeter 115 could be altered, such as with a non-linear shape, to aid with opening a formed package. It is to be understood that a wide variety of configurations and shapes for the gate panel 110, gates 114, or perimeter 15 are within the scope of the invention.

Figure 7:
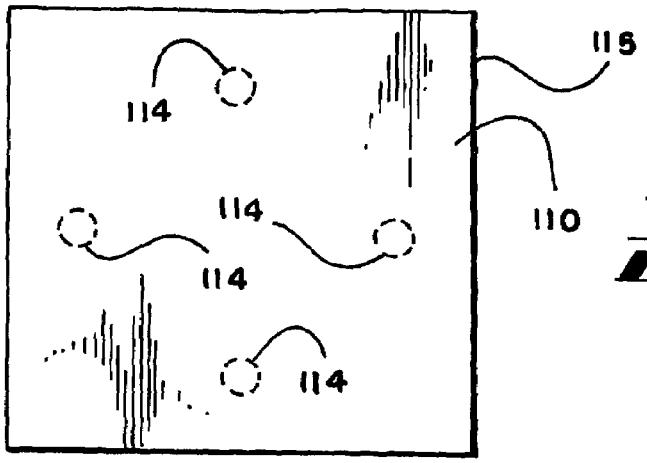
FIG. 7 is a plan view of a gate panel secured to the backing layer of a blister package according to the invention.
Figure 8:
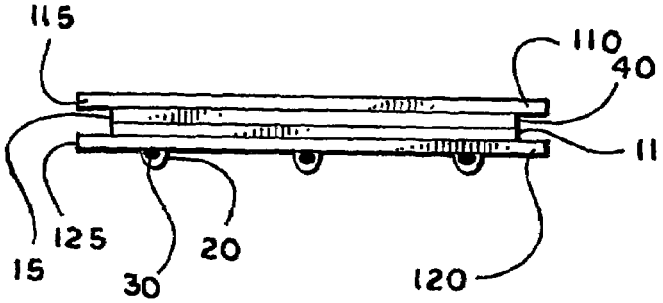
FIG. 8 is an elevation view of FIG. 7.

FIGS. 7 and 8 illustrate a gate panel 110 secured to the backing layer 40 of a blister package. The gate panel 110 can be secured to the backing layer 40 using any suitable technique including adhesives. For example, the gate panel 110 could be coated with an adhesive coating and press applied to the backing layer 40.

Figure 9:
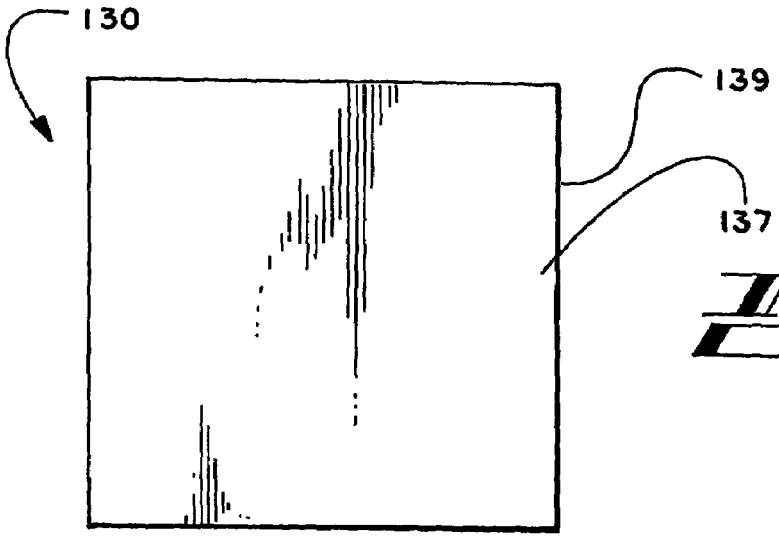
FIG. 9 is a plan view of a substrate for forming a tab panel according to the invention.
Figure 10:
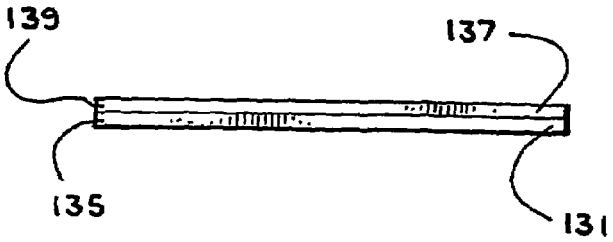
FIG. 10 is a side view of FIG. 9.

FIGS. 9 and 10 illustrate an exemplary substrate 130 suitable for forming a tab panel 140 (illustrated in FIG. 11) according to the invention. An adhesive coating 137, such as easy Seal Plus manufactured by MeadWestvaco Corporation, with perimeter 139 is secured to the substrate 131 with perimeter 135.

Figure 11:
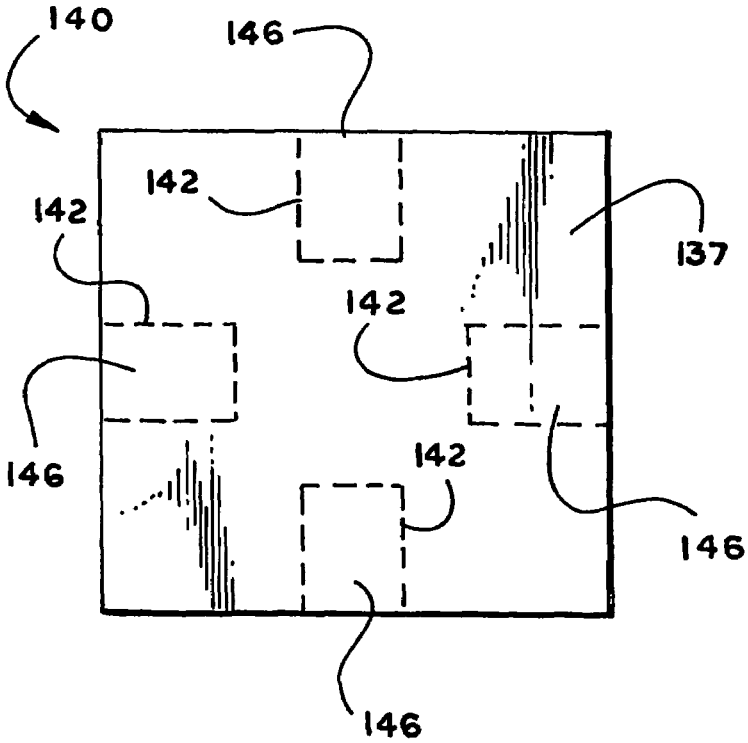
FIG. 11 is a plan view of a tab panel formed according to the invention.

FIG. 11 illustrates an exemplary tab panel 140. The tab panel 140 is illustrated with at least partially detachable tabs 146 with a tab perimeter 142. In an exemplary method the tab perimeter 142 can be formed by partial die cuts or other suitable means. It is to be understood that the tabs 146 could also be fully removable. In addition the perimeter of the tab panel 140 can be shaped (not shown) to aid with opening a formed package. It is to be understood that the tab panel 140, perimeter, tabs 146, and tab perimeters 142 could be configured in numerous shapes and dimensions according to the invention.

Figure 12:
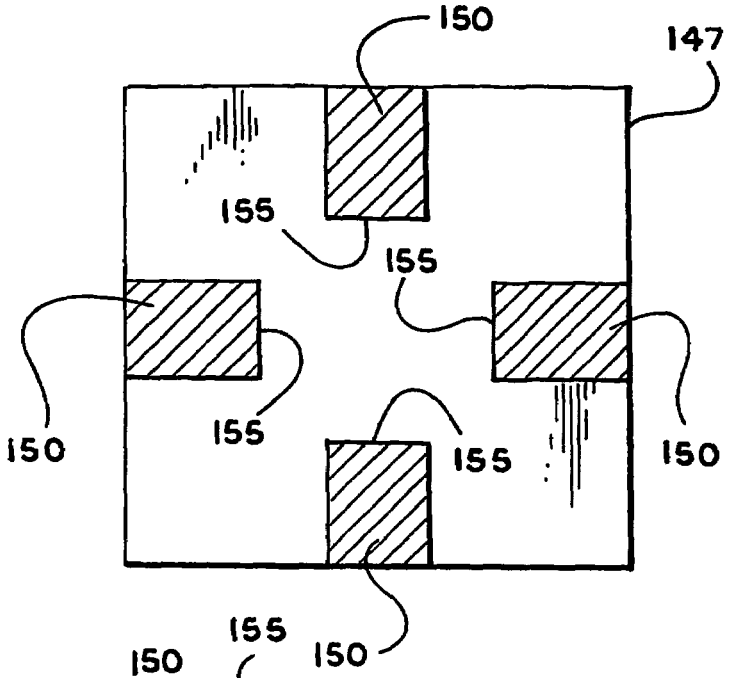
FIG. 12 is a plan view of FIG. 11 after selectively patterning the coated surface according to the invention FIG. 13 a side view of FIG. 11.
Figure 13:
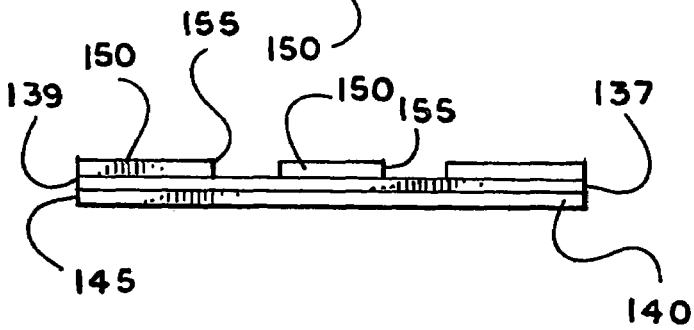

FIGS. 12 and 13 illustrate the tab panel 140 of FIGS. 11 with selective areas 150 of the adhesive coating 137 covered. The selective areas 150 have a perimeter 155. In an exemplary method according to the invention, a release agent such as silicon or wax products manufactured by J.M. Fry Company, or other suitable products are secured to the adhesive coating 137 to coat the selective areas 150. The areas 150 are configured to approximate the perimeters 142 for the tabs 146.

Figure 14:
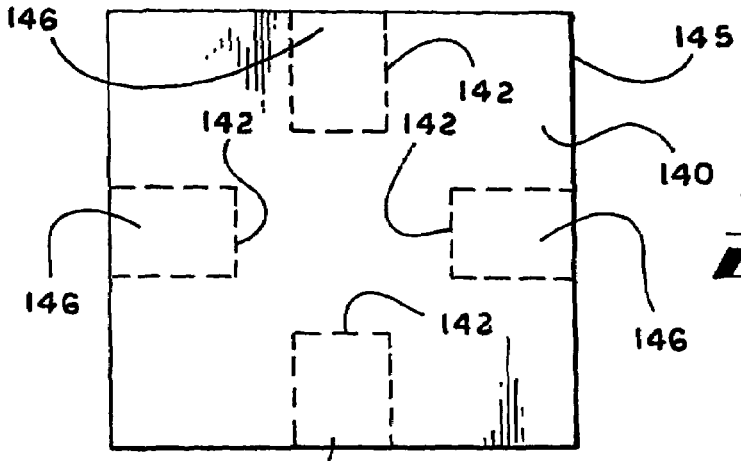
FIG. 14 is a plan view of the tab panel secured to FIG. 8.
Figure 15:
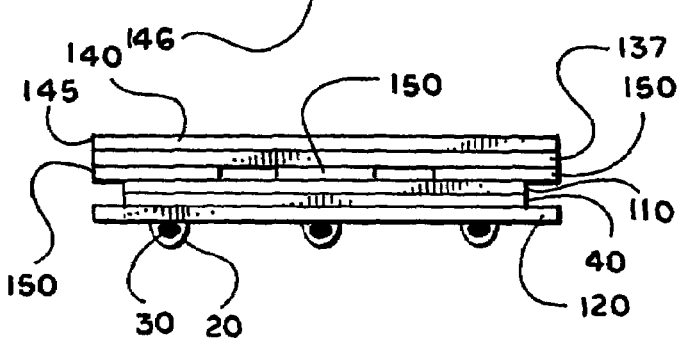
FIG. 15 is a side elevation view of FIG. 14.

FIGS. 14 and 15 illustrate the tab panel 140 secured to the gate panel 110. The tab panel 140 can be secured to the gate panel 110 using any suitable technique including adhesives 137. The release layer prevents gates 114 from adhering to the tabs 146 as the tabs are pulled. As illustrated in FIG. 15, the release agent in selective areas 150, only allows portions of the tab panel 140, outside of the tab perimeter 142 to secure to the gate panel 110. This assists the end user with reaching the blister contents 30 by allowing a finger or other mechanical device to more easily access the tabs 146.

Figure 16:
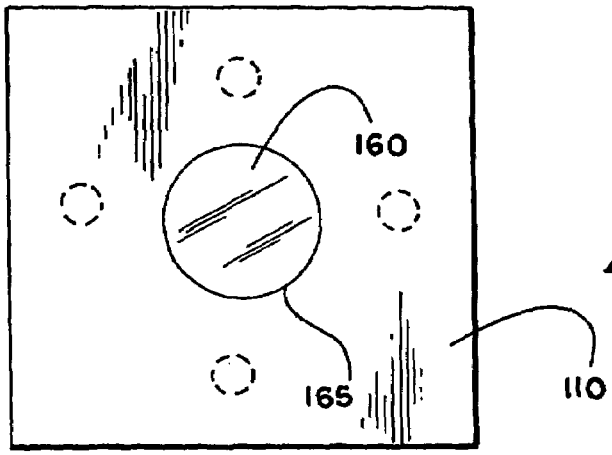
FIG. 16 is a plan view of another embodiment according to the invention.
Figure 17:
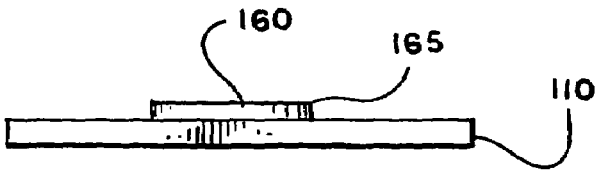
FIG. 17 is a side view of FIG. 16.

FIGS. 16 and 17 illustrate another embodiment for creating the separation between the tabs 146 and the gate panel 110. In this embodiment, the adhesive 137 illustrated above in FIGS. 9 and 10 and the release agent coated areas 150 illustrated in FIGS. 12 and 13 are eliminated. In their place any suitable adhesive 160 with perimeter 165 is place on the gate panel 110. As illustrated in FIG. 17, the central location of the adhesive 160 prevents the tab panels 146 from adhering to the gate panel 100 thus providing the same benefit described above without the need for the release agent coating.

Figure 18:
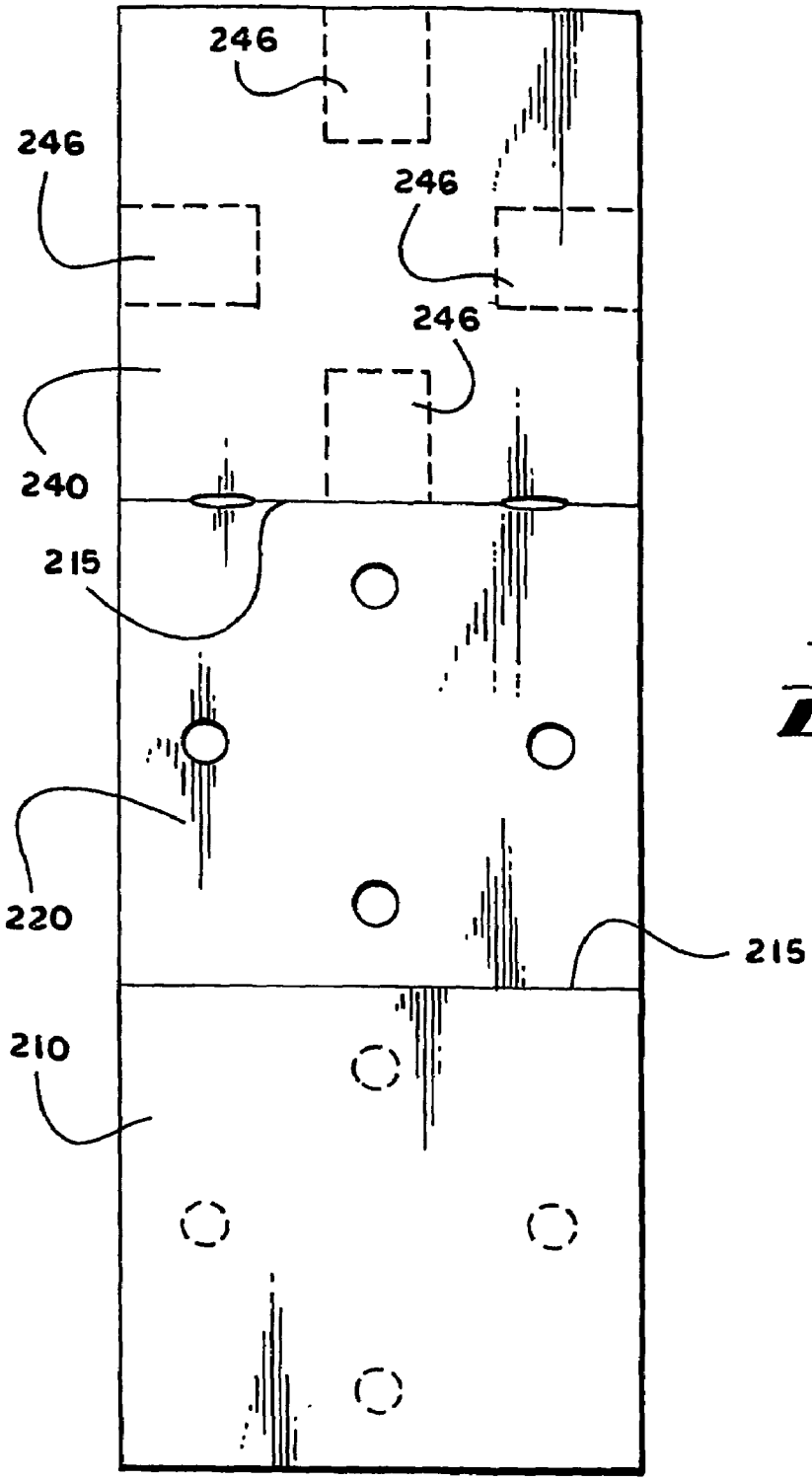
FIG. 18 is a plan view of another embodiment according to the invention.

FIG. 18 illustrates another embodiment according to the invention. Gate panel 210, aperture panel 220, and tab panel 240 are illustrated secured to each other along fold lines 215. In this embodiment, the tab panel 240 may optionally be secured to the gate panel 210 without the use of coatings or other means to space the tab regions from the gate panel 210. After inserting a blister tray, the panels may be folded along fold lines 215 and may be secured to gate panel 210 peripherally outside of the tab areas 246.

Figure 19:
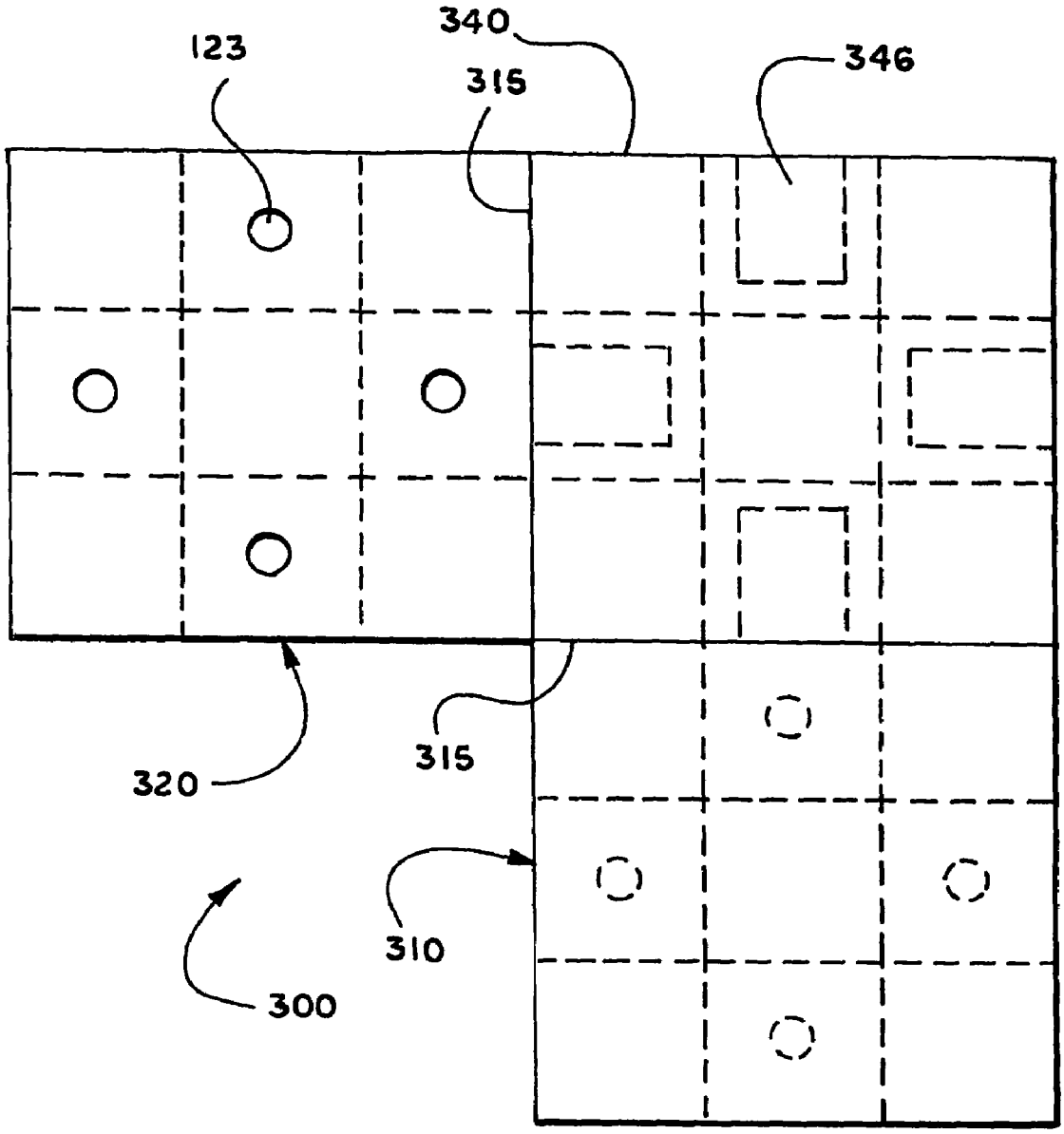
FIG. 19 is a plan view of another embodiment according to the invention.

FIG. 19 illustrates another embodiment according to the invention. The gate panel 310, aperture panel 320, and tab panel 340 are configured in a different. arrangement. The gate panel 310 and the aperture panel 320 are connected to the tab panel 340 along fold lines 315 in the L-shaped blank 300. After inserting blisters 20 in apertures 123, the panels are folded along fold lines 315. Blister base 11 is adhered to aperture panel 320 and to gate panel 310, and gate panel 310 is adhered to tab panel 340 outside of the tab areas 346. This embodiment illustrates one of several different arrangements that are within the scope of the claimed invention.

The extended peripheral areas of the aperture panel, the gate panel, and the tab panel may be glued to each other. That mechanically traps the blister base 11 and backing 40 between the aperture and gate panels. The peripheral areas of the tabs may be release coated or otherwise excluded from the adhesive joining of the peripheral areas of the panels The various panels described above may be formed from any suitable substrate material to include conventional paperboard grades, for example solid bleached sulfate (SBS) paperboard ranging in weight of about 10 point or greater. An exemplary substrate 100 includes a 12-point SBS board manufactured by MeadWestvaco Corporation. Another exemplary substrate is paperboard coated on one side with Easy Seal Plus® manufactured by MeadWestvaco Corporation. The substrate 100 may also be a laminated board, a coated board, an unbleached board, or a synthetic paper or a mixture of these depending on the desired appearance of the package. An exemplary substrate has at least one side that is compatible with a printing method. The other side should be suitable for an adhesive coating. Any suitable means for securing the various panels to each other and the blister pack are within the scope of the invention. The various panels should ideally be arranged and secured to each other so that a formed package would have printing on at least some part of the exterior of the package.

Once given the above disclosure, many other features, modifications or improvements will become apparent to the skilled artisan. Such features, modifications or improvements are, therefore, considered to be a part of this invention, the scope of which is to be determined by the following claims.

The invention claimed is:

1. An apparatus comprising:

an aperture panel with at least one aperture;

a blister tray, at least some portion of said tray protruding through said aperture panel;

a gate panel secured to said aperture panel with at least one gate, a given said at least one gate being substantially aligned with a corresponding said at least one aperture when said gate panel is in contact with said aperture panel;

a tab panel secured to said aperture panel with at least one substantially detachable tab, the tab panel being substantially dimensioned and aligned with said gate panel so that a given said at least one substantially detachable tab is substantially aligned with a corresponding said at least one gate when said tab panel is in contact with said gate panel;

an adhesive coating formed on the tab panel and the corresponding said at least one substantially detachable tab thereof; and a release agent applied to said gate panel in the vicinity of said at least one gate to prevent adhesion thereof to the adhesive coating on a corresponding said at least one substantially detachable tab.

2. The apparatus of claim 1 wherein said gate panel further comprises a perforated region that is substantially dimensioned and aligned with a given said at least one substantially detachable tab.

3. The apparatus of claim 1 wherein a given said at least one substantially detachable tab of said tab panel is not secured to said gate panel.

4. A blister package apparatus for holding a product comprising:

at least one blister for holding a product;

an aperture panel with at least one aperture receiving the at least one blister;

a gate panel having at least one gate, said at least one gate being aligned with a corresponding said at least on blister positioned opposite a given said at least one aperture, the given said at least one aperture being configured for providing access to the product through a corresponding said at least one gate;

a tab panel having at least one tab, each respective said at least one tab being aligned with a corresponding said at least one gate and configured for providing access thereto upon at least partially detaching the respective said at least one tab;

an adhesive coating formed on the tab panel and the corresponding said at least one tab thereof; and a release agent applied to the gate panel in the vicinity of said at least one gate to prevent adhesion thereof to the adhesive coating on a corresponding said at least one tab.

5. The apparatus of claim 4 wherein the gate panel and tab panel are joined by glue.

6. The apparatus of claim 4 wherein the gate panel and tab panel are centrally joined by glue.

7. The apparatus of claim 4 wherein the gate panel and the tab panel have opposing surfaces and wherein the opposing surfaces, with the exception of surfaces of the at least one tab, are glued together.

8. The apparatus of claim 4 wherein the aperture panel, the gate panel, and the tab panel are joined at edges and are folded inward at the joined edges, with the aperture panel over the at least one blister, the gate panel under the at least one blister and the tab panel under the gate panel.

9. The apparatus of claim 4 wherein the panels have areas that are joined by gluing.

10. The apparatus of claim 4 wherein the panels have peripheral areas that are joined by gluing.

11. The apparatus of claim 4 further comprising a backing on the at least one blister, and wherein the gate panel is attached to the backing.

12. The apparatus of claim 4 wherein the at least one blister comprises a plurality of blisters on a blister tray;

wherein the product comprises products in the blisters;

wherein the at least one aperture comprises a plurality of apertures in the aperture panel for receiving the plurality of blisters;

wherein the at least one gate comprises a plurality of gates in the gate panel aligned with the plurality of blisters on the blister tray opposite the plurality of apertures on the aperture panel;

and wherein the at least one tab comprises a plurality of tabs in the tab panel aligned with the plurality of gates.

13. The apparatus of claim 12 further comprising a backing on the blister tray, and wherein the gate panel is attached to the backing.

14. The apparatus of claim 12 wherein the blister tray has an upper surface which is attached to the aperture panel;

further comprising a backing attached to the blister tray for holding the products in the blisters;

wherein the gate panel is attached to the backing; and wherein the tab panel is attached to the gate panel, except for at the tabs.

15. The apparatus of claim 12 wherein the tab panel is centrally glued to the gate panel.

16. The apparatus of claim 14 wherein the aperture panel, the gate panel and the tab panel have peripheral areas extending outward beyond the blister tray and the backing, and further comprising adhesive interconnecting the peripheral areas.

17. The apparatus of claim 12 wherein the aperture panel, the gate panel, and the tab panel have joined edges and are folded inward at the joined edges, with the aperture panel over the blister tray, the gate panel under the blister tray and the tab panel under the gate panel.

18. The apparatus of claim 12 wherein the aperture panel has opposite lateral edges, and wherein the gate panel and the tab panel have lateral edges attached respectively to the opposite lateral edges of the aperture panel and wherein the panels are folded and secured in positions parallel to the blister tray.

19. The apparatus of claim 12 wherein the panels are joined along plural edges of one of the panels and along single edges of remaining ones of the panels and are folded and secured in positions parallel to the blister tray.

20. The apparatus of claim 12 wherein the gates have perforations which may be separated by pushing on the blisters and the products within the blisters after the tabs have been removed.

21. The apparatus of claim 12 wherein the tabs have perforations around edges of the tabs and have accessible ends for lifting the ends and tearing the perforations for removing the tabs and exposing the gates.

22. The apparatus of claim 21 wherein the tabs extend to the edges of the tab panel and wherein the ends of the tabs are accessible along the edges of the tab panel.

23. A child resistant packaging method comprising:

providing an aperture panel having at least one aperture;

providing a gate panel having at least one gate;

providing a tab panel having at least one tab;

providing an adhesive coating on the tab panel and the at least one tab thereof;

providing a blister tray having at least one blister;

providing a product in the at least one blister;

providing a backing on the blister tray holding the product in the at least one blister;

applying a release agent to the gate panel in the vicinity of at least one given gate to prevent adhesion thereof to the adhesive coating on a corresponding tab;

extending the at least one blister through the at least one aperture;

aligning the at least one gate with the at least one blister opposite the at least one aperture;

covering the at least one gate with the at least one tab;

securing the blister tray between the aperture panel and the tab panel.

24. The method of claim 23 wherein the providing the panels further comprises providing the panels with joined edges and folding the panels along the joined edges.

25. The method of claim 23 wherein the providing the panels further comprises providing peripheral areas on the panels and adhering the peripheral areas together.

26. The method of claim 23 further comprising moving the at least one tab and exposing the at least one gate and pushing on the at least one blister and freeing a product from the at least one blister through the backing and the at least one gate.

27. The method of claim 26 wherein the moving the at least one tab comprises lifting an end of the at least one tab and tearing perforations along opposite sides of the at least one tab and wherein the forcing the product through the at least one gate comprises breaking the gate from the gate panel at perforations along the gate.

28. The method of claim 23 wherein the at least one tab and the at least one gate prevent the product from moving through the at least one gate until the at least one tab is moved away from the at least one gate.

29. The apparatus of claim 1 wherein a single aperture panel is provided.

30. The apparatus of claim 1 wherein a single blister tray is provided.

31. The apparatus of claim 1 wherein a single gate panel is provided.

32. The apparatus of claim 1 wherein a single tab panel is provided.

33. The apparatus of claim 1 wherein the release agent is applied to the gate panel over an area corresponding to that of at least one tab.

* * * * *